United States Patent [19]

Sasaki et al.

[11] 4,307,565

[45] Dec. 29, 1981

[54] SPUN YARN-LIKE TEXTURED COMPOSITE YARN AND A PROCESS FOR MANUFACTURING THE SAME

[75] Inventors: Yoshiyuki Sasaki, Takatsuki; Masayuki Tani; Katsuyuki Kasaoka, both of Ibaraki, all of Japan

[73] Assignee: Teijin Limited, Osaka, Japan

[21] Appl. No.: 6,219

[22] Filed: Jan. 24, 1979

[30] Foreign Application Priority Data

Jan. 27, 1978 [JP] Japan ..... 53-7154
Jun. 16, 1978 [JP] Japan ..... 53-72192

[51] Int. Cl.[3] ..... D02G 1/02; D02J 1/08

[52] U.S. Cl. ..... 57/205; 57/2; 57/207; 57/228; 57/288

[58] Field of Search ..... 57/204–208, 57/288, 289, 2

[56] References Cited

U.S. PATENT DOCUMENTS 3,577,873 5/1971 Waters ..... 57/205
3,691,750 9/1972 Waters ..... 57/205
3,991,548 11/1976 Toronyi et al. ..... 57/205
4,051,660 10/1977 Griset, Jr. ..... 57/205
4,070,817 1/1978 Bueb et al. ..... 57/289 X
4,145,870 3/1979 Klee et al. ..... 57/289 X
4,164,117 8/1979 Talbot ..... 57/289
4,164,836 8/1979 Tanae et al. ..... 57/2

*Primary Examiner*—John Petrakes
*Attorney, Agent, or Firm*—Burgess, Ryan and Wayne

[57] ABSTRACT

Disclosed is a textured composite yarn composed of a first multifilament yarn having a lower extensibility and a second multifilament yarn having a higher extensibility, as well as a process for manufacturing such textured composite yarn. The first multifilament yarn forms a core yarn, while the second multifilament yarn is wrapped at least partially around the core yarn. Some individual filaments of the second multifilament yarn are entangled and interlaced with some filaments of the first multifilament yarn in the boundary region between the core yarn and the wrapping yarn.

15 Claims, 27 Drawing Figures

SPUN YARN-LIKE TEXTURED COMPOSITE YARN AND A PROCESS FOR MANUFACTURING THE SAME

BACKGROUND OF THE INVENTION (1) Field of the Invention

The present invention relates to a textured composite yarn (core-wrapped composite yarn) having a spun yarn-like appearance and touch, and a process for the manufacture of the same.

(2) Description of the Prior Art

As disclosed in the specifications of U.S. Pat. No. 3,577,873 and No. 3,691,750, when at least two filamentary yarns differing in extensibility under stress are doubled, fed to a feed roller and twisted by a false twist element, the filamentary yarn having a lower extensibility occupies a core portion because of its reduced tendency to elongate, while the filamentary yarn having a higher extensibility is twisted to wrap the core portion helically because it is readily elongated. When this twisted state is thermally set and untwisting is thereafter effected, there is obtained a textured composite yarn having two layers, which yarn comprises a core portion mainly composed of the filamentary yarn having a lower extensibility and a wrapping portion composed of the filamentary yarn having a higher extensibility and helically wrapping the core portion in the twisted state.

Incidentally, by the term "yarn" used in the instant specification is meant a filamentary yarn unless otherwise indicated.

Such finished yarn is ordinarily manufactured at a processing speed lower than 100 m/min. However, to obtain a finished yarn of this type for use in making high quality woven or knitted fabrics, the yarn must be carefully prepared at a processing speed as low as 60 m/min or less. However, production at such a low speed tends to be very inefficient, thus disadvantageously causing the resultant product to be commercially unprofitable.

The reason why such a low processing speed must be adopted is because the stability of the specific structure inherent to an alternately twisted and wrapped yarn tends to be very poor and is not sufficiently high enough to withstand the false twisting (crimping) and weaving steps. Especially at the false twisting step, the composite yarn structure is more delicately changed in accordance with the speed of the texturing processing as compared with the structure of a filamentary yarn which is subjected to a texturing processing. More specifically, at a processing speed lower than 60 m/min, a uniform textured composite yarn structure comprising a core yarn and a yarn helically and alternately wrapping the core yarn in a twisted state can be obtained, and at a processing speed approximating to 100 m/min, a textured composite yarn structure wherein the wrapping by the filamentary yarn is partially incomplete and non-uniform will inevitably be obtained. However, at a processing speed of 150 to 250 m/min, the wrapped structure is manifested at a few locations, and at a processing speed exceeding 300 m/min, no wrapped structure is formed and only a crimped yarn composed of two completely separate yarns can be obtained.

Namely, the configuration of the two-layer textured composite yarn is changed to that of a textured yarn produced by a twisting-untwisting method or false-twisting method, as the processing speed is increased, and the quality of a woven or knitted fabric formed from a yarn manufactured at a high processing speed is degraded, that is, the spun yarn-like appearance or touch is drastically degraded. Further, in the portion having no wrapped structure, slacks corresponding to the difference between the extensibility of the core yarn and that of the wrapping yarn are created in the wrapping yarn, thereby forming neps in the winding zone during the false twisting step or during the weaving step. Finally, serious defects such as troubles occurring during operation and drastic reduction of the quality of the final product will be caused by the neps formed in the yarn.

In the above-mentioned slackened portion, filaments are present substantially in a free state, and even if a woven or knitted fabric can be formed from a yarn having such slackened portions, the anti-pilling property is extremely poor and the product is not fit for long-time wearing. Accordingly, various defects will be caused during actual application of such product.

SUMMARY OF THE INVENTION

It is therefore the primary object of the present invention to provide a spun yarn-like textured composite yarn which has none of the above-mentioned defects exhibited by the conventional textured composite yarns, and in which the yarn structure comprising a core portion and a wrapping portion is permanently stabilized, and formation of neps and pills is effectively prevented.

The second object of the present invention is to provide an improved textured composite yarn which is modified from the above-mentioned spun yarn-like textured composite yarn satisfying the above primary object by generating fluffs on the surface of the latter textured composite yarn so as to obtain more distinctive spun yarn-like characteristics.

The third object of the present invention is to provide a process for preparing spun yarn-like textured composite yarns as mentioned above.

The primary object of the present invention can be attained by providing a spun yarn-like textured composite yarn comprising a false twisted core yarn composed of a plurality of filaments and a wrapping yarn composed of a plurality of filaments at least partially wrapping the core yarn helically, wherein the directions of the helices of the filaments reverse at intervals along the yarn length, and some of the filaments constituting the wrapping yarn are intermingled and interlaced with some of the filaments constituting the core yarn in the boundary region between the core yarn and the wrapping yarn.

The second object of the present invention can be attained by providing a spun yarn-like textured composite yarn formed by modifying the above-mentioned textured composite yarn satisfying the primary object so that the filaments constituting the surface portion of the yarn are cut at many points to form fluffs.

In our basic research to fine a method for producing the above-mentioned textured composite yarn, it was confirmed that if two multifilament yarns having different extensibilities are doubled and processed by the so-called false twisting operation at a high processing speed, a double layer twisted construction of the doubled yarn created by the twisting operation, wherein the yarn having the higher extensibility wraps the yarn having the lower extensibility, is inevitably destroyed by the successive untwisting operation so that the so-called textured composite yarn cannot be produced. Therefore it was conceived that, if the component individual filaments of those two multifilament yarns are well interlaced so as to combine those two yarns before subjecting them to the successive false twisting operation, the above-mentioned problem can be overcome. However, the interlaced and intermingled condition of the individual filaments of the two multifilament component yarns prevents the above-mentioned double-layer twisted yarn from being formed during the twisting operation due to the interlacing and intermingling phenomena, even though the extensibilities of the two yarns are distinctly different. Therefore, to find a practical method for producing the textured composite yarn according to the present invention, the most important step is to find a solution to overcome the problem existing between the condition desired for producing the above-mentioned double-layer twisted yarn by the twisting operation and the condition desired for producing the textured composite yarn according to the present invention by the successive untwisting operation. As the result of our basic research, the above-mentioned problem was successfully solved by selecting different extensibilities for the two-material multifilament yarns, by utilizing a doubled yarn formed by interlacing and intermingling the above-mentioned yarn materials, and by carrying out the false twisting operation under an underfeed condition.

Therefore, the third object of the present invention can be attained by utilizing a process comprising the step of introducing a multifilament yarn having a lower extensibility (yarn A) and a multifilament yarn having a higher extensibility (yarn B) into a turbulent fluid zone to intermingle and interlace both individual filaments of these yarns with each other, and the step of subjecting the resulting combined yarn to a false twisting-crimping treatment under an underfeed condition.

In order to obtain a yarn satisfying the second object, an auxiliary treatment should be carried out so as to generate fluffs. According to the present invention, there is provided a very practical process in which fluffs are effectively formed by conducting the false twisting treatment while using an outer contact type frictional false twister.

As will be apparent to those skilled in the art, similar results can be obtained by adopting, instead of a process wherein the above-mentioned two steps are carried out continuously, a process in which an interlaced yarn formed by the intermingling and interlacing treatment is used as a starting yarn material, and this yarn is subjected to a false twist-crimping treatment under an underfeed condition.

DETAILED DESCRIPTION OF THE PREFERRED EMBODIMENT

Figure 1A:
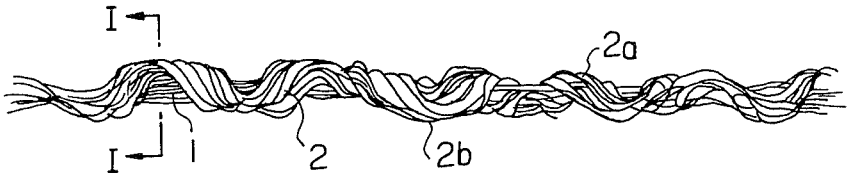
FIG. 1A is a schematic representation of a textured composite yarn according to the present invention.

As pointed out hereinbefore, the process for manufacturing a textured composite yarn of the present invention comprises a step of twisting a doubled yarn formed by intermingling and interlacing two multifilament yarns having different extensibilities so that the twisted doubled yarn has two layers wherein the multifilament yarn having the lower extensibility forms a core portion and the other multifilament yarn having the higher extensibility is wrapped around the above-mentioned core yarn, while some individual filaments of the above-mentioned wrapping yarn are entangled with some individual filaments of the yarn forming the above-mentioned core portion, a step of heat-setting the twisted yarn, and a successive step of untwisting the above-mentioned twisted doubled yarn so that the desired configuration of the textured composite yarn according to the present invention can be created.

In the modified process for manufacturing the textured composite yarn according to the present invention, a false twist operation is successively carried out just after the above-mentioned intermingled and interlaced two multifilament yarns having different extensibilities are formed, in other words, this modified process involves a step of forming the above-mentioned intermingled and interlaced yarn in a continuous process for manufacturing the textured composite yarn according to the present invention.

For the sake of understanding the process for manufacturing the textured composite yarn according to the present invention, the basic technical concept of the present invention will be explained hereinafter.

As pointed out hereinbefore, in the process for manufacturing a textured composite yarn such as the well-known yarn disclosed in U.S. Pat. No. 3,577,873 or U.S. Pat. No. 3,691,750, if the false twisting operation for a doubled yarn composed of two multifilament yarn materials having different extensibilities is carried out at a high running speed faster than 150 m/min, there is a tendency for the continuous configuration of the yarn having two layers to be destroyed or to separate into two yarn materials.

Therefore, it was first conceived that, if the individual filaments of two multifilament yarns are intermingled and interlaced in the doubled yarn, the above-mentioned undesired changes in the yarn configuration can be prevented from occurring. However, according to our basic research, it was found that, if a doubled yarn composed of two multifilament yarns having different extensibilities (wherein the individual filaments of those two yarns are intermingled and interlaced) is fed to a first twisting process under an overfeed condition such as that in a conventional process, since the individual filaments of the two yarns are intermingled and interlaced with each other, it is almost impossible to create a yarn having a configuration wherein the yarn having the lower extensibility forms a core portion while the material yarn having the higher extensibility is wrapped around the core portion, in spite of the fact that two multifilament yarns having different extensibilities are being used. Consequently, even if the twisted yarn created by the above-mentioned first twisting operation under a heated condition is untwisted, it is still impossible to create a textured composite yarn having a configuration such that the yarn having the lower extensibility forms a core portion while the yarn having the higher extensibility is periodically wrapped around the core portion with helices reversing at different intervals along the textured composite yarn.

According to our careful study into the reason causing the occurrence of the above problem, it was found that, during the process of twisting the doubled yarn composed of the two multifilament yarns having different extensibilities (wherein the individual filaments of those two yarns are intermingled and interlaced with each other), since the above-mentioned doubled yarn is fed to the twisting process under an overfeed condition, the individual filaments of both yarns are not stretched enough so that the intermingled and interlaced condition of the individual filaments of both yarns cannot be destroyed. In other words, the individual filaments of both yarns cannot move freely; consequently, the difference between the extensibilities of the individual filaments of both yarns is not effective for creating a yarn having such a configuration that the yarn with the lower extensibility forms a core portion while the yarn having the higher extensibility is wrapped around the core portion and some of the individual filaments of both yarns are intermingled and interlaced with each other. To solve the above-mentioned problem, various conditions for processing the above-mentioned doubled yarn were examined. Finally, it was confirmed that, if the above-mentioned doubled yarn, wherein the difference in breaking elongation between the two multifilament yarns is at least 70%, preferably 100% to 250%, is fed to the above-mentioned false twisting process under a pertinent underfeed condition, in which condition the draw ratio is at least 1.05, preferably 1.2 to 1.5, the above-mentioned problem can be preferably solved. Furthermore, it was confirmed that in the case where one of the multifilament yarns consists of partially oriented filaments and the other multifilament yarn consists of undrawn filaments, it is preferable that the first yarn has a breaking elongation of 100 to 250%, the second yarn has a breaking elongation of at least 250%, and that the difference in breaking elongation between the two yarns is at least 80%. That is, for example, a multifilament yarn, which can be used as a yarn for draw-false twisting, is utilized as the yarn with the lower extensibility. Another yarn of a higher extensibility is combined with the first yarn so as to form a doubled yarn wherein the individual filaments of both yarns are intermingled and interlaced together. When the doubled yarn is subjected to a false twisting process under the above-mentioned underfeed condition, since the individual filaments of both yarns are stretched, each of the two kinds of filaments will exhibit a different degree of stress and strain so that the two kinds of filaments will function as two respective groups of filaments within the same resultant composite yarn. Consequently, the configuration of the resultant textured composite yarn will be such that the individual filaments of the yarn having the lower extensibility will mainly form a core portion and the individual filaments of the material yarn having the higher extensibility will mainly wrap around the core portion with reversing helices formed at intervals along the resultant yarn, while some individual filaments of both constituent yarns are intermingled and interlaced at portions adjacent to the boundary between both yarns.

Figure 1B:
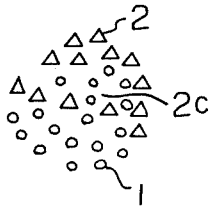
FIG. 1B is a schematic sectional view of the textured composite yarn as shown in FIG. 1A, taken along line I—I of FIG. 1A.

The general configuration of the textured composite yarn thus produced is shown in FIG. 1, wherein the individual filaments of the yarn having the lower extensibility forms a core portion 1, and the individual filaments of the yarn having the higher extensibility are wrapped around the core portion 1 with portions 2*a*, while individual filaments of the two material yarns are provided with numerous crimps. On the other hand, some individual filaments of the two yarns are intermingled and interlaced at portions of the layers adjacent to the boundary between the core portion 1 and the wrapping portion 2*a* as shown in FIG. 1B.

A typical structure of the textured composite yarn obtained according to the present invention is characterized by the state wherein the direction of the helices of a wrapping component reverse successively, e.g., there being no complete wrapping between adjacent points of reversal (hereinafter this state is referred to as a state of successive reversal of alternate twists). Such yarn exhibits a softer hand characteristic than that of a spun yarn because the covering power increases slightly due to a decrease in the degree of wrapping. Furthermore, twist effects can be still maintained due to the presence of the successive reversal of alternate twists.

The above structure can preferably be realized by using the so-called simultaneous draw-texturing process, employing an outer contact type frictional false twister while maintaining a K value (ratio of untwisting tension (grams) to twisting tension (gram)) to a level of 0.6 to 0.9, a draw ratio of 1.2 to 2.0, and an elongation difference between the core and the wrapper of at least 100%.

Figure 2:
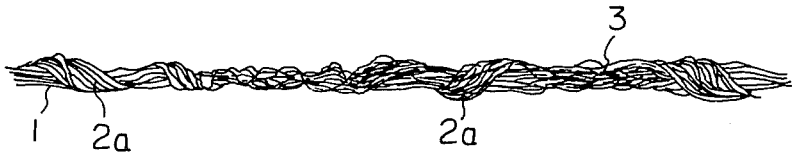
FIG. 2 is a schematic representation of another textured composite yarn according to the present invention.

It was also confirmed that it was possible to produce a textured composite yarn having a configuration similar to the above-mentioned configuration and additionally having yarn portions wherein the individual filaments of the two component yarns are intermingled and interlaced with each other, by selecting the difference between the extensibilities of the two multifilament yarns, and by selecting the underfeed condition. The typical configuration of such textured composite yarn is shown in FIG. 2, wherein the produced yarn is provided with yarn interlaced portions 3 wherein the individual filaments of the core yarn are randomly intermingled and interlaced with the individual filaments of the wrapping yarn.

From experiments made by us, it was confirmed that in order to obtain a processed yarn having the above-mentioned yarn configuration, it is necessary to form at least 30 interlacing points, preferably at least 50 interlacing points, per meter of the interlaced yarn material which is subjected to the false twisting treatment. After the false twisting treatment, more than 50% of the interlacing points can be found in the resultant textured composite yarn. To ensure a good yarn handling and running characteristic, at least 20 interlacing points per meter should be present in the resultant yarn. This degree of interlacing is determined according to the following method.

An interlaced yarn is allowed to float on water contained in a vessel. A non-interlaced portion of the yarn is opened laterally, therefore the diameter of the yarn is increased several times at this opened portion, while an interlaced portion of the yarn is not opened and the original diameter of the interlaced portion can be substantially retained. Accordingly, the interlacing points can be mounted with the naked eye.

As pointed out hereinbefore, the entangling and interlacing treatment is not preferred for creating a two-layer structure of the textured composite yarn. However, according to the present invention, by using yarns that can be false twisted under underfeed conditions and by selecting two yarns differing greatly in extensibility, the disadvantage caused by the entangling and interlacing treatment can be sufficiently overcome. Furthermore, the intended textured composite yarn can be formed due to the effects attained by utilizing an intermingling and interlacing treatment while using two multifilament yarn materials having different extensibilities.

In addition, according to the present invention, defects created in the conventional textured composite yarns, for example, formation of neps during the weaving step or the like, can be eliminated, and the handling property of the resulting textured composite yarn can be remarkably improved. Moreover, since the woven or knitted fabric made from this textured composite yarn has a highly improved quality and a good anti-pilling property, therefore, a spun yarn-like touch and appearance can be imparted thereto.

Figure 3:
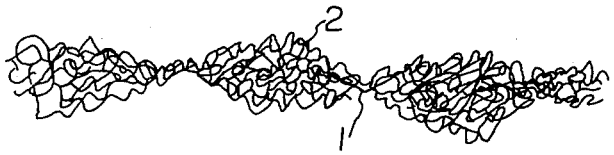
FIG. 3 is a schematic representation of a conventional textured composite yarn treated by using a fluid-interlacing treatment.

It may be considered that the weaving property of a conventional textured composite yarn, formed by doubling yarns differing in extensibility and by subjecting the doubled yarn to false twisting under an overfeed condition, can be improved by passing this processed yarn through an air jet nozzle to effect an interlacing treatment. In this case, however, the yarn configuration is destroyed by turbulent air streams, so that filaments of the core yarn are exposed to the outside and entangled and interlaced with filaments of the wrapping yarn. Accordingly, the wrapped structure is destroyed and, instead, a crimped yarn structure is formed in which filaments differing in extensibility are entangled together, as shown in FIG. 3. Accordingly, another defect is caused in that the touch of the resulting yarn is not substantially different from the touch of a conventional textured yarn, although the weaving property of the resulting yarn is improved to some extent.

In contrast, in the processed yarn of the present invention, the wrapping yarn comprises a wrapping portion 2*a*, a portion 2*b* where the wrapping direction is reversed and an interlaced portion 2*c*, as shown in FIGS. 1A and 1B. Therefore, since the weaving property of the textured composite yarn according to the present invention is remarkably improved, there can be obtained a woven or knitted fabric having an appearance similar to that of the fabric made of a spun yarn and a touch quite different from the touch of a woven or knitted fabric made of a conventional textured crimped yarn.

An embodiment of the continuous process for manufacturing the textured composite yarn according to the present invention will now be described with reference to FIG. 4.

Two yarns 3*a* and 3*b* differing in extensibility are doubled by a guide 4 and then fed to an air jet nozzle 7 so as to be subjected to an intermingling and interlacing treatment via a tension device 5 and a pair of feed rollers 6. The doubled yarn is formed into an interlaced yarn having at least 30 interlacing points per meter by the air jet nozzle 7. Then, the interlaced yarn is fed into a false twisting zone by a pair of first delivery rollers 8 under an underfeed condition, and is then taken up by a pair of secondary delivery rollers 11 via a heater 9 and a false twister 10 and wound into the form of a cheese 13 by means of a friction roller 12. In the embodiment shown in FIG. 4, a hollow spindle is used as the false twister 10. In the present invention, another false twister, for example, a frictional false twister, can be conveniently employed.

Any type of air jet nozzles can be used for the intermingling and interlacing treatment. In general, however, a customary interlacing processing nozzle as disclosed in U.S. Pat. No. 2,985,995 or a Taslan processing nozzle as disclosed in U.S. Pat. No. 2,783,609 and U.S. Pat. No. 3,279,024 is preferably employed. The interlaced yarn may be wound after the interlacing treatment, or it may be subsequently subjected continuously to the false twisting treatment. A spindle comprising a twist pin on which the yarn is wound, a fluid type pneumatic false twisting nozzle, or an inner or outer contact type of frictional false twister can be used. Similarly, the false twisting-crimping conditions to be used can be appropriately chosen from among conditions customarily adopted in the art.

Figure 5:
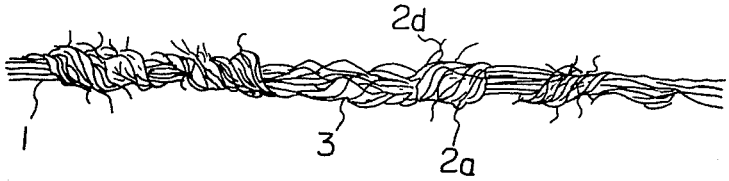
FIG. 5 is a schematic representation of another embodiment of the textured composite yarn according to the present invention.

When a frictional false twister is simultaneously used as a raising member, some of the filaments of the wrapping yarn 2 wrapped helically around the filaments of the core yarn 1 are cut; such cut filaments 2*d* project from the surface of the textured composite yarn thus produced like fluffs of a spun yarn as shown in FIG. 5. As a result, the appearance and touch of the thus-produced texture core yarn resemble more closely to those of a spun yarn.

Figure 4:
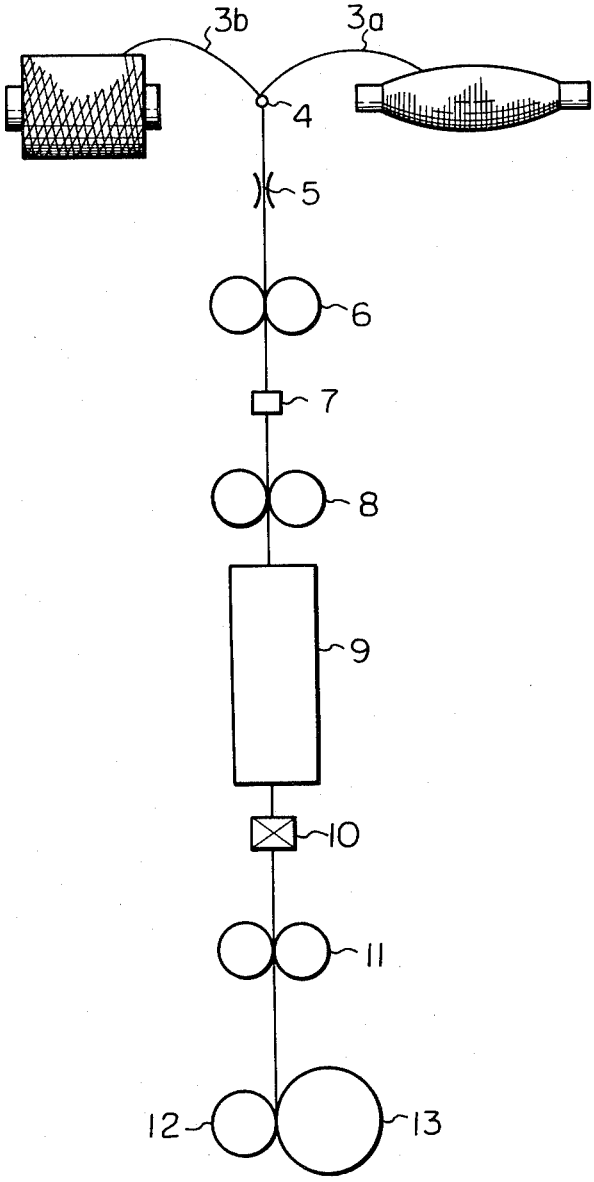
FIG. 4 is a schematic front view of a continuous apparatus utilized for producing a textured composite yarn from two multifilament yarns having different extensibilities according to the present invention.
Figure 7A:
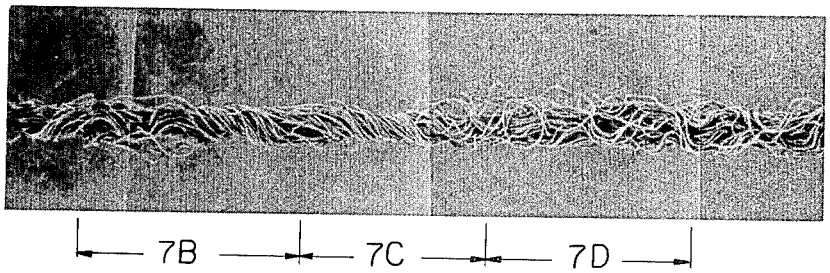
FIG. 7A is a photograph taken by a scanning electron microscope representing the textured composite yarn produced by the process of Example 1.
Figure 7B:
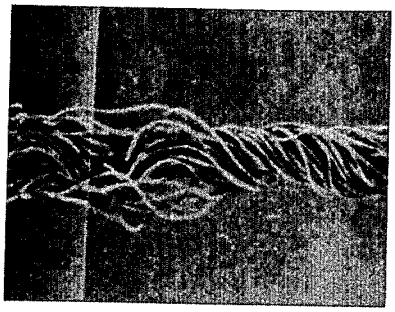
FIGS. 7B, 7C and 7D are enlarged scanning electron microscope photographs showing the textured composite yarn of FIG. 7A, wherein the wrapped portion is shown in FIGS. 7B and 7C and the interlaced portion is shown in FIG. 7D.
Figure 7C:
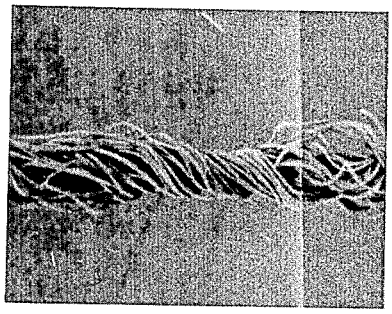
Figure 7D:
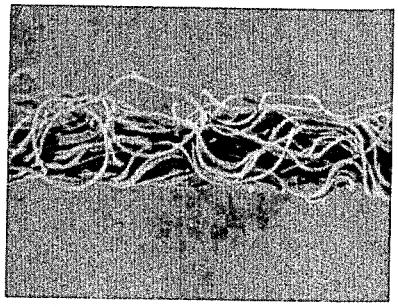
Figure 8A:
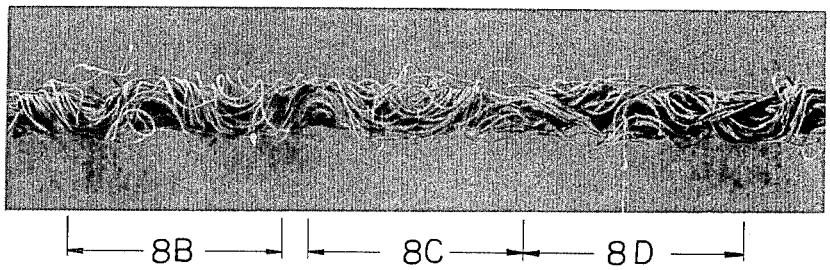
FIG. 8A is a photograph taken by a scanning electron microscope representing the textured composite yarn produced by the process of Example 2.
Figure 8B:
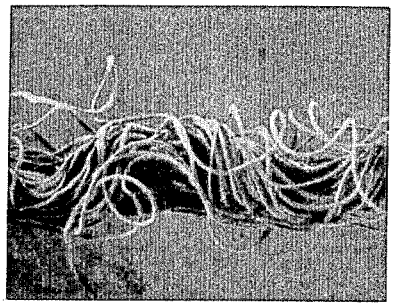
FIGS. 8B, 8C and 8D are respective enlarged scanning electron microscope photographs showing the wrapped portions of the yarn shown in FIG. 8A, wherein the individual component filaments of the wrapping yarn are partly entangled with the individual component filaments of the core yarn at the boundary layer portions therebetween.
Figure 8C:
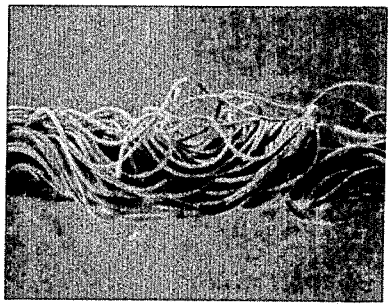
Figure 8D:
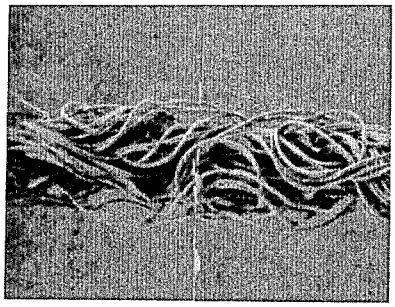

The embodiment illustrated in FIG. 4 is a so-called single heater process; therefore, the resulting processed yarn has a considerable torque. Accordingly, when the resulting processed yarn is used for producing a knitted fabric, it is preferred that a second heater be utilized to diminish the torque.

In the present specification, by the term "filamentary yarn" is meant a thermoplastic synthetic multifilament yarn, especially one composed of polyethylene terephthalate. The constituent polyethylene terephthalate may comprise up to 15 mole % of a third comonomer component. Furthermore, the polyethylene terephthalate may contain additives such as a delustering agent, a coloring agent and a flame retardant.

In the core yarn and the wrapping yarn, conditions such as the sectional configuration of the filaments, the content of the delustering agent and the absence or presence of the coloring agent may be changed, or at least one of these conditions may remain the same in both yarns. When a yarn that can be easily dyed with a basic dye is used as the core yarn, a good color-mixing effect can be obtained in the final product.

The thickness of each of the core yarn and wrapping yarn should be appropriately determined according to the end use. In general, it is preferred that the total denier of the wrapping yarn be equal to or greater than the total denier of the core yarn. It is especially preferred that the total denier of the wrapping yarn be in the range of from 75 to 350 denier and that the total denier of the core yarn be in the range of from 50 to 150 denier. The denier of the individual filament is determined in view of the draw ratio at the processing step. In general, it is preferred that the denier of the individual filaments forming the core yarn after processing be equal to or greater than the denier of the individual filaments forming the wrapping yarn after processing. It is especially preferred that the denier of the individual filaments forming the wrapping yarn after processing be less than 3 and that of the core yarn after processing be greater than 3. By using core and wrapping yarns having the above-mentioned denier characteristics, there can be obtained a textured composite yarn capable of producing a woven or knitted fabric having a good bulkiness, a soft surface touch, a high stiffness, a good resilient property and other advantageous properties.

In the above-mentioned embodiment according to the present invention, the continuous process for manufacturing the textured composite yarns has been illustrated. Of course, there may be adopted a process in which the intermingling and interlacing treatment is carried out separately from the false twisting treatment, or there may be adopted a process in which a doubled yarn formed by intermingling and interlacing two multifilament yarns differing in extensibility is used as the yarn material and in which this doubled yarn is false twisted under underfeed conditions. In each case, the same results as those obtained by using the above-mentioned continuous process can be substantially obtained.

In order to create fluffs in the textured composite yarn having a yarn structure as shown in FIG. 5, a raising treatment may be advantageously carried out. In this embodiment a rotary or fixed rough surface member or cutting blade as disclosed in, for example, U.S. Pat. No. 3,001,358, Japanese Patent Publications No. 19743/71, No. 38379/74, No. 7891/73 or No. 31942/73, is advantageously used as the raising member. In general, it is preferred that such cutting and raising member be disposed in a cooling zone extending between the outlet end of a heater of a false twisting-crimping machine and a false twister. However, from a practical viewpoint, it is preferred that, as described hereinbefore, a frictional false twister of an outer contact frictional type including a raising frictional disc plate be used instead of such cutting and raising member and false twister disposed independently from each other.

Figure 6:
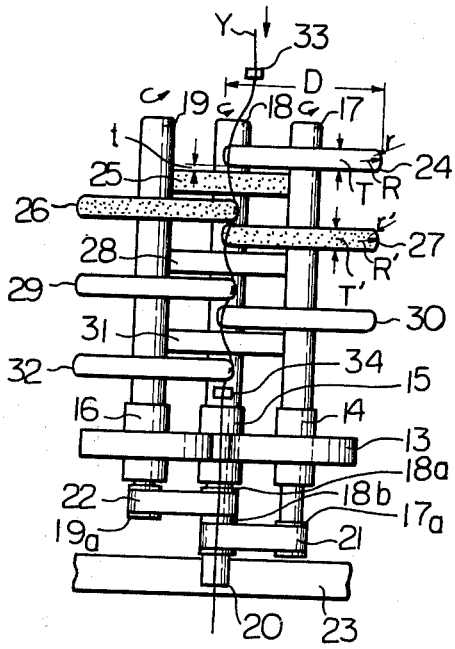
FIG. 6 is a schematic front view of a false twisting device of a frictional contact principle utilized in the apparatus for producing the textured composite yarn according to the present invention.

FIG. 6 is a front view showing the above-mentioned false twister. Three or more shafts, each including a plurality of frictional disc members attached thereto, are arranged in parallel to one another so that the disc members of the respective shafts are disposed in a state where they partially overlap and cross one another. These frictional disc members are divided into two types, a twisting frictional member for imparting false twists to a yarn and a raising frictional member for imparting fluffs to the yarn.

Referring to FIG. 6, three bearings 14, 15 and 16 are mounted on a bracket 13 substantially at three apexes of an equilateral triangle, respectively. Shafts 17, 18 and 19 are rotatably pivoted via the bearings 14, 15 and 16, respectively. A pulley 17*a* is integrally mounted on the lower end of the shaft 17, pulleys 18*a* and 18*b* and a driving wheel 20 are integrally mounted or fixed on the lower end of the shaft 18, and a pulley 19*a* is integrally mounted on the shaft 19. A power transmission member such as a timing belt 21 is stretched out between the pulleys 17*a* and 18*b*, and a power transmission member such as a timing belt 22 is similarly stretched out between the pulleys 18*a* and 19*a*. When the driving wheel 20 is driven by a driving means such as a belt 23, the rotational power is transmitted to the shaft 18 from the driving wheel 20 and is then transmitted from the pulleys 18*a* and 18*b* to the shafts 17 and 19 through the timing belts 21 and 22 and the pulleys 17*a* and 19*a*, respectively. Thus, the shafts 17, 18 and 19 are rotated in the same direction.

Frictional disc members 24, 25, 26, 27, 28, 29, 30, 31 and 32 are fixed to the shafts 17, 18 and 19, respectively. These frictional disc members are divided into two types, a twisting frictional member for imparting false twists to a supplied yarn and a raising frictional member for creating fluffs in the yarn. In an embodiment shown in FIG. 6, frictional disc members 24, 28, 29, 30, 31 and 32 are twisting frictional members having no raising action, and frictional disc members 25, 26 and 27 are twisting frictional members with raising actions.

As can be seen from the above-mentioned illustration, a plurality of frictional disc members fixed to the three shafts 17, 18 and 19 are divided into twisting frictional members for imparting false twists to a supplied yarn and raising frictional members for creating fluffs in the yarn, which discs are arranged so that the two types of frictional disc members can independently produce false twisting and raising actions. If the frictional disc members are thus divided, according to functions, into twisting frictional members for mainly effecting the twisting action and raising rough surface members for mainly effecting the raising action, it is possible to satisfy simultaneously the requirement for creating a necessary high level false twisting effect and the requirement for forming many short fluffs. Since a high false twisting effect can be attained by using twisting frictional members, the filament bundle is temporarily tightly assembled by the imparted twists, and since in this assembled condition, the filament bundle is rubbed and raised, short fluffs can be created by the rough surface raising members. Moreover, even if the surface of each raising frictional member is roughened to such an extent that a sufficient number of fluffs can be created, the number of false twists is not decreased. Accordingly, it is possible to use an adequate number of raising frictional members having a surface roughness necessary for creating a preferably large number of fluffs, which number is necessary for creating a desirable number of fluffs. Therefore, in the processed yarn produced by using such frictional disc members, a sufficiently high bulkiness is created by the high level false twisting (the bulkiness is ordinarily attained by heat setting of false twists), and simultaneously, this processed yarn has a large number of short fluffs.

According to the experimental tests which will hereinafter be described in Examples 4 through 8, for twisting the doubled yarn, it is preferable to use a frictional disc member, which has a thickness T in a range of between 5 mm and 10 mm and a radius of a curvature R at the arched edge portion thereof being $\frac{3}{4}$ to 1 time greater than the thickness T. If the above-mentioned conditions regarding T and R are satisfied, it is possible to maintain the difference between the peripheral speed of the frictional disc at the point where the yarn comes into contact with the disc and the peripheral speed of the frictional disc at the point where the yarn moves away from the disc, within a small magnitude. As a result, a uniformly twisted doubled yarn can be obtained. Furthermore, if the thickness T of the frictional disc for twisting is designed to be large, the area where the yarn comes into contact with the disc will be increased thus providing sufficient frictional disc action for overcoming the disc action which creates fluffs. Consequently, the textured composite yarn has a very uniform configuration, and a high bulkiness in the resulting product can be created. With respect to the cross-sectional profile of the edge of the frictional disc member, it is preferable to design the disc such that the radius of its curvature, represented by r, is sufficiently small as compared with the above-mentioned radius of a curvature R so that a pertinent zig-zag yarn passage can be created during operation. It is also preferable to use a frictional contact disc having a diameter within a range of between 40 mm and 55 mm. With respect to the frictional member for creating fluffs in the yarn, it is preferable to use a member having a size and shape similar to those of the frictional disc member having the above-mentioned conditions.

In a practical false twister utilizing the above-mentioned frictional disc members, it is preferable to arrange the frictional disc members in such a condition that the edge profiles of the frictional disc members partly overlap each other in the direction along the rotational axis thereof, and that the intervening distance t between two adjacent discs is generally less than 1.0 mm. If the distance t exceeds the above-mentioned upper limit, the condition of the yarn running through the false twister becomes unstable. On the other hand, if the intervening distance t is less than 0.3 mm, the threading of the yarn into this false twister becomes difficult.

In the false twisting and raising apparatus having the above-mentioned structure, a yarn Y travels from the yarn guide 33 to a yarn guide 34 through a yarn passage defined by the frictional disc members which are overlapping and crossing one another, while having sliding contact with these frictional disc members.

In the so-created spun yarn-like textured core yarn having a fluffy appearance of the present invention, the relationships between the type of yarn materials and the structures of the respective yarns as compared with their corresponding characteristics and properties are illustrated as follows.

| Material | Extensibility | Structure | Characteristic |
|---|---|---|---|
| Core yarn | Low | Positioned in the core part of the textured composite yarn | Low probability of yarn being fluff-raised exerts an effect of maintaining the strength of the entire yarn. |
| Wrapping yarn | High | Alternately twisted and wrapped around the core yarn | Impartation of spun yarn--like appearance and touch |
| | | Have fluffs | Increase of softness and spun yarn-like appearance and touch |
| | | Portion wherein the filaments of the core yarn and the filaments of the wrapping yarn are partially interlaced | (i) Action of stabilizing the wrapping structure (improvement of the weaving and knitting properties)<br>(ii) Stabilization of fluffs (anti-pilling effect)<br>(iii) Stabilization of the wrapping structure (effect of preventing formation of neps) |

As will be apparent from the above-mentioned illustration, the fluffy yarn of the present invention has a two-layer wrapped structure in which filaments of the wrapping yarn are partially entangled and interlaced with filaments of the core yarn as shown in FIG. 5. To obtain a fluffy appearance and a soft touch, it is necessary to form at least 50 fluffs per meter in the yarn. To prevent the formation of pillings in the textured composite yarn, it is especially advantageous that the percentage of fluffs having a fluff length of less than 2 mm be preferably maintained around at least 80% of the total number of fluffs.

Accordingly, weaving and knitting properties can be remarkably improved, and the resultant textured composite yarn can provide a woven or knitted fabric having an appearance and touch which are similar to those of a fabric made of spun yarn, but which are different from the appearance and touch of a woven or knitted fabric made of a conventional crimped yarn.

The present invention will now be described in detail with reference to the following Examples which by no means limit the scope of the invention.

EXAMPLE 1

A polyester filamentary yarn (96 denier/24 filaments) having a breaking elongation of 70%, produced by conducting spinning at a speed of 4500 m/min, and a polyester filamentary yarn (180 denier/48 filaments) having a breaking elongation of 190% and solution-dyed black in order to be visually distinguished, obtained by conducting spinning at a speed of 2700 m/min, were doubled together, and thereafter subjected to an interlacing treatment and a draw-false twisting treatment according to the process illustrated in FIG. 4.

More specifically, the two yarns 1 and 2 were fed to feed rollers 6 and then subjected to the interlacing treatment between the feed rollers 6 and the first delivery rollers 8 at an overfeed ratio of 0.5% under a compressed air pressure of 2 $Kg/cm^2$ to form 35 interlacing points per meter. Then, the interlaced yarn was fed to the false twisting zone through the rollers 8 and subjected to the simultaneous draw-false twisting treatment at a draw ratio of 1.284, a false twist number of 2400 T/m, a heater temperature of 180° C. and a yarn speed (the speed of second delivery rollers 11) of 100 m/min.

When the thus-obtained processed yarn was observed by means of a scanning electron microscope, it was found that as shown in FIGS. 7A, 7B, 7C and 7D, the processed yarn was a uniformly alternately twisted two-layer structure yarn and that in the boundary portion between the core yarn 1 and the wrapping yarn 2, some of the filaments constituting the core yarn 1 and some of the filaments constituting the wrapping yarn 2 were interlaced and entangled together (30 interlacing points per meter). When a woven fabric was produced by using the thus-obtained processed yarn, problems such as formation of neps were not caused during the weaving process, and the resulting woven fabric had an appearance and touch very similar to those of a woven fabric made of a spun yarn. The wrapped portion of FIG. A is shown on an enlarged scale in FIGS. 7B and 7C. The interlaced and intermingled portion of FIG. A is shown on an enlarged scale in FIG. 7D.

COMPARATIVE EXAMPLE 1

A drawn polyester filamentary yarn (75 denier/15 filaments) having a breaking elongation of 25% and a polyester filamentary yarn (115 denier/36 filaments) spun at a speed of 3500 m/min and having a breaking elongation of 110% were doubled and subjected to the interlacing treatment and false twisting treatment according to the process shown in FIG. 4.

The interlacing treatment was carried out in the same manner as that described in Example 1. Since the drawn yarn having a breaking elongation of 25% was a yarn that could not be false twisted under drawing, the false twisting treatment was carried out under conditions of an overfeed ratio of 5%, a twist number of 2400 T/m, a heater temperature of 220° C. and a yarn speed of 100 m/min.

With respect to the so-obtained processed yarn, manifestation of the two-layer structure was not satisfactory and the yarn had no alternately twisted wrapped structure. When a woven fabric was prepared by using this processed yarn, no problem was caused in the weaving process. However, the resulting woven fabric lacked a spun-like appearance and touch and was not substantially different from an ordinary fabric woven from a conventional textured yarn.

COMPARATIVE EXAMPLE 2

A polyester filamentary yarn (96 denier/24 filaments) spun at a speed of 4500 m/min and having a breaking elongation of 70% and a polyester filamentary yarn (180 denier/48 filaments) spun at 3400 m/min and having a breaking elongation of 120% were doubled together and subjected to the interlacing treatment and false twisting treatment according to the process shown in FIG. 4. Both the interlacing treatment and the false twisting treatment were carried out under the same conditions as those described in Example 1.

Tentatively, the yarn was comprised of a core yarn 1 and a wrapping yarn 2, but it did not include an alternately twisted wrapped structure because the difference in breaking elongation was not greater than 70%. When a woven fabric was prepared by using this yarn, no substantial problem was caused during the weaving process, however the resulting fabric lacked a spun-like appearance and touch and the fabric was not substantially different from an ordinary fabric woven from a conventional textured yarn.

EXAMPLE 2

A polyester filamentary yarn (115 denier/24 filaments) spun at a speed of 3500 m/min and having a breaking elongation of 112% and a polyester filamentary yarn (220 denier/72 filaments) solution-dyed black in order to be visually distinguished, spun at a speed of 1500 m/min and having a breaking elongation of 350% were doubled together and subjected to the interlacing treatment and draw-false twisting treatment according to the process shown in FIG. 4.

The interlacing treatment was carried out at an overfeed ratio of 2.5% under a compressed air pressure of 4 $kg/cm^2$ by using an interlacing nozzle to form 60 interlacing points per meter. Subsequently, the stretch-false twisting treatment was carried out at a draw ratio of 1.55, a twist number of 2500 T/m, a K value of 0.8, a heater temperature of 180° C. and a yarn speed of 350 m/min. In this Example, in order to elevate the processing speed, an outer contact type frictional false twister (see FIG. 6) was used as the false twister.

The thus-obtained processed yarn was a uniformly alternately twisted two-layer textured composite yarn exhibiting a state of successive reversal of alternate twists as shown in FIGS. 8A, 8B, 8C, and 8D which are photographs taken by means of a scanning electron microscope. Interlacing of some filaments of the core yarn 1 with some filaments of the wrapping yarn 2 was observed in the boundary portion between the core yarn 1 and wrapping yarn 2 (the number of interlacing points was 50 per meter). When a woven fabric was prepared by using this yarn, problems such as formation of neps were not caused during the weaving process. The resulting fabric had a soft touch and appearance similar to those of a fabric made of a spun yarn or spun yarns.

EXAMPLE 3

A polyester filamentary yarn (140 denier/24 filaments) spun at a speed of 2900 m/min and having a breaking elongation of 150% and a polyester filamentary yarn (220 denier/72 filaments) spun at a speed of 1500 m/min and having a breaking elongation of 350% were doubled together and subjected to the interlacing treatment and draw-false twisting treatment according to the process shown in FIG. 4.

The interlacing treatment was carried out at an overfeed ratio of 3.0% under a compressed air pressure of 3.5 kg/cm$^2$ by using an interlacing nozzle to form 47 interlacing points per meter. Subsequently, the stretch-false twisting treatment was carried out at a draw ratio of 1.892, a twisted number of 2450 T/m, a K value of 0.9, a heater temperature of 200° C. and a yarn speed of 400 m/min. Also, in this Example, an outer contact type frictional false twister was used as the false twister.

Figure 9A:
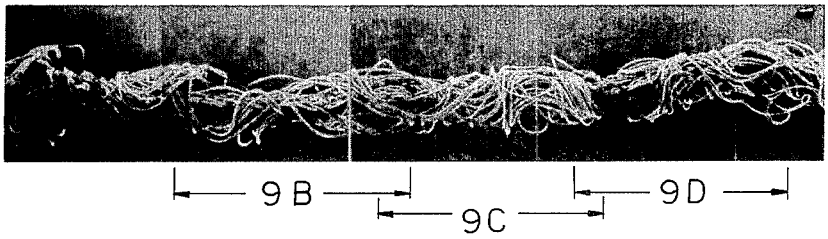
FIG. 9A is a photograph taken by a scanning electron microscope representing the textured composite yarn produced by the process of Example 3.
Figure 9B:
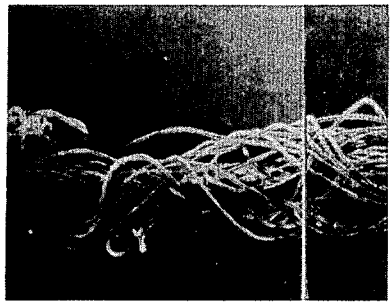
FIGS. 9B, 9C and 9D are respective enlarged scanning electron microscope photographs showing the wrapped portions of the textured composite yarn shown in FIG. 9A, wherein the individual component filaments of the wrapping yarn are partly entangled with the individual component filaments of the core yarn at the boundary layer portions therebetween.
Figure 9C:
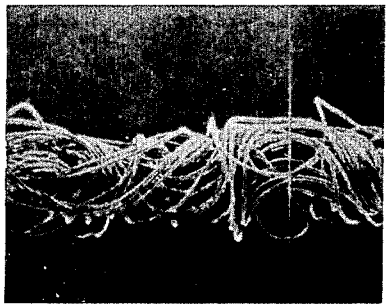
Figure 9D:
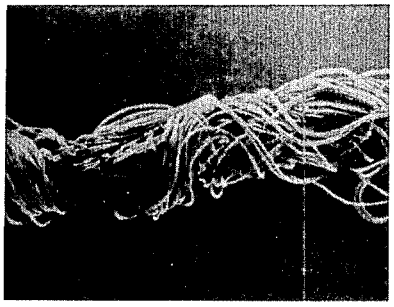

The thus-obtained processed yarn had a structure as shown in FIG. 9A, (the number of interlacing points was 42 per meter). This yarn did not cause any problems during the weaving process and provided a woven fabric having a soft touch and appearance similar to those of the fabric made of a spun yarn or spun yarns. The enlarged photographs of the wrapped portions in FIG. 9A, wherein some individual filaments of the wrapping yarn are intermingled and interlaced with some individual filaments of the core yarn, are shown in FIGS. 9B, 9C and 9D.

EXAMPLE 4

Processing was carried out in the same manner as that described in Example 2 except that the false twister shown in FIG. 6 including frictional disc members shown in Run No. 1 of Table 1, below, was used as the false twister 10.

Figure 10A:
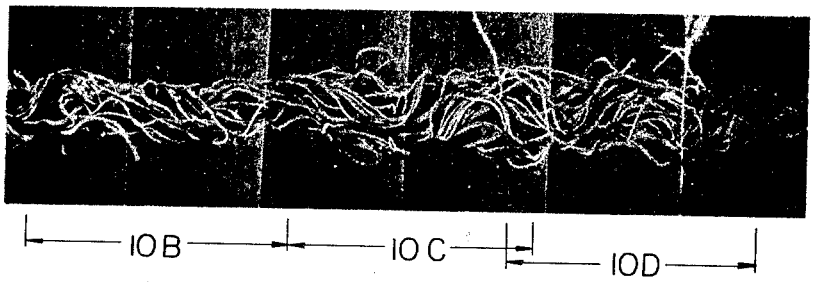
FIG. 10A is a photograph taken by a scanning electron microscope representing the textured composite yarn produced by the process of Example 4.
Figure 10B:
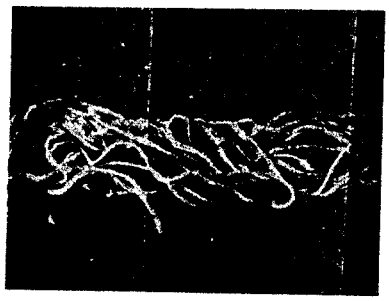
FIGS. 10B, 10C and 10D are respective enlarged electron microscope photographs, wherein the wrapped portions having a distinct number of cut filaments in FIG. 10A are shown in FIGS. 10C and 10D and the interlaced portions are shown in FIG. 10B.
Figure 10C:
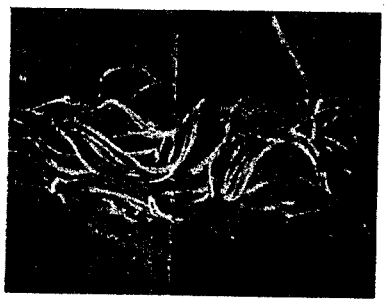
Figure 10D:
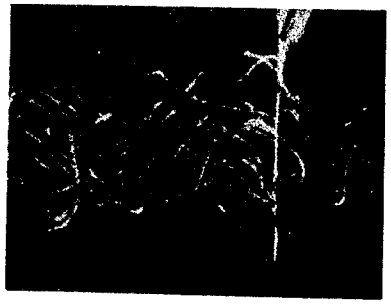
Figure 11A:
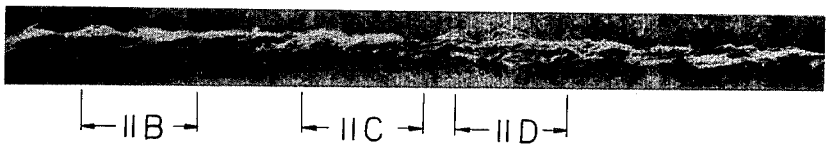
FIG. 11A is a photograph taken with an optical microscope representing the textured composite yarn produced by Example 9.
Figure 11B:
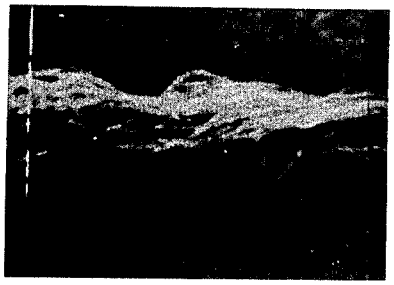
FIGS. 11B, 11C and 11D are enlarged microscope photographs of the textured composite yarn shown in FIG. 11A.
Figure 11C:
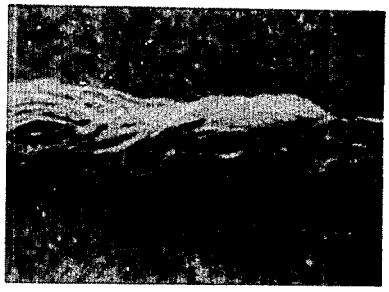
Figure 11D:
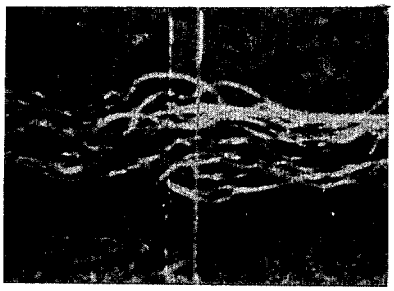

When the thus-obtained processed yarn was examined by means of a scanning electron microscope, it was found that the yarn was a fluffy processed yarn having a uniformly, alternately twisted two-layer composite yarn structure provided with numerous fluffs 2*d* as shown in FIG. 10A, and that in the boundary portion between the core yarn 1 and the wrapping yarn 2, some filaments of the wrapping yarn 2 were interlaced with some filaments of the core yarn 1 to form 51 interlacing points per meter. When a woven fabric was prepared by using this processed yarn, problems such as formation of neps were not caused during the weaving process. The resulting woven fabric had an appearance and touch similar to those of a fabric made of spun yarn(s). Enlarged photographic views of the wrapped portions exhibiting a fluffy yarn appearance are shown in FIG. 10C and FIG. 10D. An enlarged photographic view of the interlaced portion is shown in FIG. 10B.

The false twisting and raising treatments were carried out in the same manner as those described above in the same Example except that the conditions for the false twister 10 were changed as indicated in Table 1. The obtained results are shown in Table 1, below.

TABLE 1

| Run No. | False Twister | Material | Surface Roughness | Number of Plates | Measured False Twist Number (T/m) | Number of Fluffs per Meter | Proportion (%) of Short and Long Fluffs: Less than 2 mm | Proportion (%) of Short and Long Fluffs: At least 2 mm |
|---|---|---|---|---|---|---|---|---|
| | Twisting frictional plate | Ceramic | 2 S (defined by JIS, B, 0601) | 7 | | | | |
| 1 | Raising frictional plate | Diamond-coated | 600 mesh | 2 | 2,550 | 510 | 83 | 17 |
| | Twisting frictional plate | Ceramic | 2 S (defined by JIS, B, 0601) | 8 | | | | |
| 2 | Raising frictional plate | Aluminum oxide | 800 mesh | 1 | 2,500 | 430 | 78 | 22 |
| 3 | Raising frictional plate | Ceramic | 10 S (defined by JIS, B, 0601) | 9 | 1,800 | 28 | 66 | 34 |
| 4 | Twisting-raising frictional plate | Aluminum oxide | 1,000 mesh | 9 | 1,450 | 390 | 22 | 78 |

EXAMPLE 5

A false twisting device as shown in FIG. 6 was used as the false twister. Results obtained in the case where a twisting frictional disc having no raising function was disposed as the last frictional disc with which the yarn finally fell into sliding contact, were compared with results obtained in the case where a raising frictional disc having a raising action was disposed as the last disc. More specifically, results obtained in the case where the frictional discs 24, 28, 29, 30, 31 and 32 of the false twister shown in FIG. 6 were twisting frictional discs and the other frictional discs 25, 26 and 27 were raising frictional discs, were compared with results obtained in the case where the frictional discs 24, 27, 28, 29, 30 and 31 were twisting frictional discs and the frictional discs 25, 26 and 32 were raising frictional discs.

A yarn obtained by doubling an unstretched polyester filamentary yarn (220 denier/72 filaments) having a breaking elongation of 350% with a partially oriented polyester filamentary yarn (115 denier/24 filaments) having a breaking elongation of 120% and by subjecting both yarns to the conventional interlacing treatment (to form 40 interlacing points per meter) was used as the yarn material for the false twisting operation. The thus-obtained yarn was subjected to draw-false twisting and raising processing according to the process shown in FIG. 4 under the following conditions:

| | |
|---|---|
| Draw ratio | 1.55 |
| Heater temperature | 200° C. |
| Surface speed of twisting and raising frictional discs | 700 m/min |
| Yarn speed | 350 m/min |

The obtained results are shown in Table 2, below.

TABLE 2

| Run No. | Frictional Disc with which Yarn Finally Fell into Sliding Contact | Material | Surface Roughness | Measured Number of False Twists (T/m) | Number of Fluffs per Meter | Proportions (%) of Short and Long Fluffs: Less than 2 mm | Proportions (%) of Short and Long Fluffs: At least 2 mm | Frequency of Yarn Breaks per 200 Hours |
|---|---|---|---|---|---|---|---|---|
| 5 | Twisting frictional disc | Ceramic | 2 S (defined by JIS, B, 0601) | 2,550 | 530 | 83 | 17 | 0.3 |
| 6 | Raising frictional disc | Diamond-coated | 600 Mesh | 2,550 | 510 | 67 | 33 | 1.0 |

From the results shown in Table 2, it will be readily understood that in the case where a twisting frictional disc is used as the frictional disc with which the yarn finally falls into sliding contact (Run No. 5), the length of the fluffs is shorter and the yarn break frequency is lower than the fluff length and the yarn break frequency observed in the case where a raising frictional disc is used as the final frictional disc (Run No. 6).

EXAMPLE 6

A false twister comprising false twisting frictional discs and raising frictional discs as shown in FIG. 6 was used as the false twister. These frictional discs were arranged as in the embodiment shown in FIG. 6. Namely, twisting frictional discs were used as the frictional discs 24, 28, 29, 30 , 31 and 32, and raising frictional discs were used as the frictional discs 25, 26 and 27. In this Example, the effects of the diameter of the raising frictional disc were examined. The diameter of each twisting frictional disc was adjusted to 50 mm. The distance between every two adjacent shafts was adjusted to 37 mm for the shafts 17, 18 and 19. The surface roughness of each twisting frictional disc was 2S defined by JIS, B, 0601.

A yarn created by doubling an unstretched polyester filamentary yarn (220 denier/72 filaments) having a breaking elongation of 350% with a partially oriented polyester filamentary yarn (115 denier/24 filaments) having a breaking elongation of 120% and by interlacing them according to customary procedures to create 40 interlacing points per meter, was used as the yarn material. This yarn was subjected to the draw-false twisting and raising treatment according to the process shown in FIG. 4 under the following conditions.

| | |
|---|---|
| Draw ratio | 1.56 |
| Heater temperature | 195° C. |
| Surface speed of twisting and raising frictional discs | 700 m/min |
| Yarn speed | 350 m/min |

The obtained results are shown in Table 3.

TABLE 3

| Run No. | Raising Frictional Discs: Material | Raising Frictional Discs: Surface Roughness (Mesh) | Raising Frictional Discs: Diameter (mm) | Measured Number of False Twists (T/m) | Number of Fluffs per Meter | Proportions (%) of Short and Long Fluffs: Less than 2 mm | Proportions (%) of Short and Long Fluffs: At least 2 mm |
|---|---|---|---|---|---|---|---|
| 7 | Diamond-coated | 600 | 52 | 2,480 | 530 | 77 | 23 |
| 8 | Diamond-coated | 600 | 50 | 2,520 | 520 | 83 | 17 |
| 9 | Diamond-coated | 600 | 48 | 2,540 | 500 | 83 | 17 |
| 10 | Diamond-coated | 600 | 46 | 2,550 | 470 | 85 | 15 |
| 11 | Aluminum Oxide | 300 | 52 | 2,410 | 590 | 68 | 32 |
| 12 | Aluminum Oxide | 300 | 50 | 2,480 | 580 | 75 | 25 |
| 13 | Aluminum Oxide | 300 | 48 | 2,520 | 520 | 82 | 18 |
| 14 | Aluminum Oxide | 300 | 46 | 2,550 | 490 | 84 | 16 |

As can be clearly understood from the above-mentioned table, if a frictional disc member having a diameter of 50 mm or less is utilized, an effective false twisting operation, a predominant amount of short fluffs as compared to long fluffs, and good overall results can be obtained. These results are especially prominent when the degree of surface roughness of the raising frictional discs is high.

EXAMPLE 7

A false twister comprising false twisting frictional discs and raising frictional discs as shown in FIG. 6 was used. Effects caused by varying the number and arrangement of these frictional discs were examined. As shown in FIG. 6, three discs were attached to each of the shafts 17, 18 and 19. Twisting frictional discs were used as the frictional discs 24 and 32. With respect to discs 25 to 31, only one raising frictional disc was used as the frictional disc 25 (the other discs 26 to 31 being twisting frictional discs) (Run No. 15). In the other Runs, the number of raising frictional discs used was gradually increased for the discs 25 to 31. The surface roughness of each twisting frictional disc was 2S, such as defined by JIS, B, 0601. Each raising frictional disc was diamond-coated and had a surface roughness of 800 mesh.

A yarn formed by doubling an unstretched polyester filamentary yarn (220 denier/72 filaments) having a breaking elongation of 350% with a partially oriented polyester filamentary yarn (115 denier/24 filaments) having a breaking elongation of 120% and by interlacing them according to customary procedures to form 42 interlacing points per meter, was used as the yarn material. This yarn was subjected to the draw-false twisting and raising treatment according to the process shown in FIG. 4 under the following conditions.

| | |
|---|---|
| Draw ratio | 1.56 |
| Heater temperature | 210° C. |
| Surface speed of twisting and raising frictional discs | 870 m/min |
| Yarn speed | 450 m/min |

The obtained results are shown in Table 4.

TABLE 4

| Run No. | Number of Frictional Discs: Twisting Discs | Number of Frictional Discs: Raising Discs | Measured Number of False Twists (T/m) | Number of Fluffs per Meter | Proportions (%) of Short and Long Fluffs: Less than 2 mm | Proportions (%) of Short and Long Fluffs: At least 2 mm |
|---|---|---|---|---|---|---|
| 15 | 8 | 1 | 2,550 | 330 | 85 | 15 |
| 16 | 7 | 2 | 2,520 | 380 | 83 | 17 |
| 17 | 6 | 3 | 2,500 | 410 | 83 | 17 |
| 18 | 5 | 4 | 2,470 | 450 | 74 | 26 |
| 19 | 4 | 5 | 2,430 | 470 | 68 | 32 |
| 20 | 3 | 6 | 2,400 | 470 | 57 | 43 |

From the results shown in Table 4, it can be readily understood that when the number of the twisting frictional discs is larger than the number of the raising frictional discs, especially when the number of the twisting frictional discs is at least 2 times the number of the raising frictional discs (Runs Nos. 15 to 17), the number of false twists imparted to the yarn is increased thus causing the number of short fluffs to be increased. Consequently, very good results are obtained.

EXAMPLE 8

A false twister comprising false twisting and raising frictional discs as shown in FIG. 6 was used. The frictional discs were arranged as in the embodiment shown in FIG. 6. Namely, twisting frictional discs were used as the frictional discs 24, 28 and 29. These discs and the radii R and R′ of the curvature of the arcuate sections of the end faces of the twisting and raising frictional discs were examined. The diameter of each frictional disc was 50 mm, and the distance between every two adjacent shafts was adjusted to 37 mm for the shafts 17, 18 and 19. Each twisting frictional disc was composed of ceramic and had a surface roughness of 2S such as defined by JIS, B, 0601. Each of the raising frictional discs was diamond-coated and had a surface roughness of 600 mesh.

A yarn formed by doubling an unstretched polyester filamentary yarn (220 denier/72 filaments) having a breaking elongation of 350% with a partially oriented polyester filamentary yarn (115 denier/24 filaments) having a breaking elongation 120% and by interlacing them according to conventional procedures to form 40 interlacing points per meter, was used as the yarn material. This yarn was subjected to the draw-false twisting and raising treatment according to the process shown in FIG. 4 under the following conditions.

| | |
|---|---|
| Draw ratio | 1.56 |
| Heater temperature | 200° C. |
| Surface speed of twisting and raising frictional disc | 970 m/min |
| Yarn speed | 500 m/min |

The obtained results are shown in Table 5, below.

TABLE 5

| Run No. | Shape of Twisting Frictional Disc: Thickness T (mm) | Shape of Twisting Frictional Disc: Radius of Curvature R (mm) | Shape of Twisting Frictional Disc: R/T | Shape of Raising Frictional Disc: Thickness T′ (mm) | Shape of Raising Frictional Disc: Radius of Curvature R′ (mm) | Shape of Raising Frictional Disc: R′/T′ | Measured Number of False Twists (T/m) | Number of Fluffs per Meter | Proportions (%) of Short and Long Fluffs: Less than 2 mm | Proportions (%) of Short and Long Fluffs: At least 2 mm | Frequency of Yarn Breaks per 200 Hours |
|---|---|---|---|---|---|---|---|---|---|---|---|
| 21 | 6 | 5.4 | 0.9 | 6 | 4.8 | 0.8 | 2,550 | 400 | 82 | 18 | 0.4 |
| 22 | 9 | 7.2 | 0.8 | 9 | 7.2 | 0.8 | 2,500 | 480 | 80 | 20 | 0.5 |
| 23 | 6.5 | 5.2 | 0.8 | 6.5 | 4.6 | 0.7 | 2,550 | 410 | 81 | 19 | 0.5 |
| 24 | 6.5 | 5.2 | 0.8 | 6.5 | 5.9 | 0.9 | 2,550 | 390 | 82 | 18 | 0.4 |
| 25 | 9 | 7.2 | 0.8 | 9 | 7.2 | 0.8 | 2,500 | 480 | 80 | 20 | 0.5 |
| 26 | 3 | 2.4 | 0.8 | 3 | 2.4 | 0.8 | 2,250 | 280 | 65 | 35 | 0.5 |
| 27 | 4 | 3.2 | 0.8 | 4 | 3.2 | 0.8 | 2,250 | 320 | 67 | 33 | 0.5 |
| 28 | 6 | 4.2 | 0.7 | 6 | 4.8 | 0.8 | 2,300 | 390 | 71 | 29 | 0.5 |
| 29 | 6 | 7.2 | 1.2 | 6 | 4.8 | 0.8 | 2,320 | 390 | 70 | 30 | 0.5 |
| 30 | 11 | 8.8 | 0.8 | 11 | 8.8 | 0.8 | 2,400 | 430 | 76 | 24 | 0.9 |
| 31 | 3 | 2.4 | 0.8 | 3 | 2.4 | 0.8 | 2,250 | 280 | 65 | 35 | 0.5 |
| 32 | 4 | 3.2 | 0.8 | 4 | 3.2 | 0.8 | 2,250 | 320 | 67 | 33 | 0.5 |
| 33 | 6.5 | 5.2 | 0.8 | 6.5 | 3.3 | 0.5 | 2,320 | 420 | 70 | 30 | 1.2 |
| 34 | 6.5 | 5.2 | 0.8 | 6.5 | 7.8 | 1.2 | 2,550 | 300 | 80 | 20 | 0.4 |
| 35 | 11 | 8.8 | 0.8 | 11 | 8.8 | 0.8 | 2,400 | 420 | 75 | 25 | 1.0 |

As can be seen from Table 5, when the shapes of the twisting and raising frictional discs satisfy the requirements of T=5 to 10 mm, T′=5 to 10 mm, R/T=$\frac{3}{4}$ to 1 and R′/T′=3/5 to 1 (Runs Nos. 21 to 25), the number of false twists imparted to the yarn is increased and the number of short fluffs is also increased, thus making it possible to obtain very good results.

EXAMPLE 9

A partially oriented polyester filamentary yarn (115 denier/24 filaments) spun at a spinning speed of 3500 m/min and having a breaking elongation of 112% was doubled with a polyester filamentary yarn (75 denier/72 filaments) solution-dyed into black in order to be visually distinguished and having a breaking elongation of 35%, which had been obtained by conducting spinning at a spinning speed of 1500 m/min and by drawing the resulting undrawn yarn at a draw ratio of 3.5. The doubled yarn was then subjected to the Taslan processing and underfeed false twisting treatment according to the process shown in FIG. 4.

Namely, the Taslan processing treatment was carried out at an overfeed ratio of 8% under a compressed air pressure of 4 $Kg/cm^2$ by using a Taslan nozzle to form 42 interlacing points per meter, and the false twisting treatment was then carried out at an underfeed ratio of 6%, a false twist number of 2500 T/m, a heater temperature of 207° C. and a yarn speed of 85 m/min.

The resulting processed yarn was a uniformly, alternately twisted textured composite yarn having an appearance resembling the processed yarn shown in FIGS. 11A, 11B, 11C, and 11D which are photographs taken by means of an optical microscope. Namely, the processed yarn had wrapped portions and intermingled portions which appeared alternately. In the wrapped portions, some filaments of the core yarn 1 were interlaced with some filaments of the wrapping yarn 2 to form interlacing points at the portion adjacent to the boundary between the core yarn and the wrapping yarn; and in the intermingled portions all individual filaments of both the core yarn 1 and the wrapping yarn 2 were intermingled and entangled together. It was found that some loops were present on the yarn surface.

When a woven fabric was produced from the so-obtained yarn, neps were not produced during the weaving process and the resultant effects of the raising treatment were very satisfactory. The woven fabric had a soft and good touch and an appearance similar to those of fabrics made of spun yarn(s).

For comparison, the following experiments were carried out.

COMPARATIVE EXAMPLE 3

The processing treatments were conducted in the same manner as described above except that the Taslan processing treatment was omitted.

COMPARATIVE EXAMPLE 4

The resulting processed yarn was subjected to the Taslan processing treatment.

Woven fabrics were produced by using the processed yarns of Example 9, Comparative Examples 3 and 4. The anti-pilling properties and touch of the woven fabrics were examined to obtained the results shown in Table 6, below.

TABLE 6

| Pilling Test Results | Example 9 | Comparative Example 3 | Comparative Example 4 |
|---|---|---|---|
| TO-A | class 5 | class 1–2 | class 2–3 |
| TO-B | class 4–5 | class 1 | class 1–2 |
| I.C.I. Method | class 5 | class 2–3 | class 3–4 |
| Weaving Property | good | weaving impossible because of too many neps | weaving difficult because of formation of neps |
| Touch and Appearance | good color-mixing effect spun-like touch (Flannel touch) | bad color-mixing effect, many neps | spun-like touch, formation of neps |

Note:

(1) TO-A

Two test pieces, each having a size of 12.5 cm × 12.5 cm, were inserted into a TO-type pilling tester. Next, the vanes of the tester were rotated at 1200 rpm for 30 minutes. The treated test pieces were compared with standard samples graded according to classes 1 to 5. The standard sample of class 5 corresponded to a product of the highest quality, and the standard sample of class 3 corresponded to a product of the lowest quality, level applicable to a practical use.

(2) TO-B

A test piece having a size of 10 cm × 10 cm was examined and folded into halves so that the front surface of the test piece was located outside. Three sides of the folded test piece were sewn by an overlock sewing machine while leaving threads on the four corners. The yarns left on the corner were bead-knotted, and the front and back sides of the four corners were fixed by means of an adhesive so that the knotted yarns did not become loose.

An iron plate (15.5 cm × 15.5 cm) to which paper (5.5 cm × 14 cm) was pasted was attached to the inner wall of a TO-type pilling tester. Two sheets of the so-prepared samples were inserted into the pilling tester, and then the vanes of the tester were rotated at 2400 rpm for 2 minutes. Thereafter, the paper-pasted iron plate was taken out, and the vanes of the tester were rotated at 2400 rpm for 15 minutes. The samples were taken out and the anti-pilling property was evaluated in the same manner as in TO-A.

(3) I.C.I. Method

An I.C.I. (Imperial Chemical Industries) type pilling tester was used. A test piece having a size of 10 cm × 12 cm was wound on a predetermined rubber tube without extending the test piece. Four of the so-wound test pieces constituting one set were charged into a rotary box of the tester, and the rotary box was rotated at a speed of 60 rpm for 5 hours. Thereafter, those samples were taken out from the rotary box, and the anti-pilling property was evaluated in the same manner as that described in TO-A and TO-B.

What is claimed is:

1. A process for manufacturing a spun yarn-like textured composite yarn comprising a step of subjecting a first bundle of partially oriented continuous filaments and a second bundle of undrawn continuous filaments both of which can be drawn at a draw ratio of at least 1.2 in an intermingled and interlaced state having at least 30 interlacing points per meter, to a draw-false twisting and crimping treatment carried out at a draw ratio of at least 1.2 and the breaking elongation of said first bundle of continuous filaments being different by at least 70% from the breaking elongation of said second bundle of continuous filaments.

2. A process for manufacturing a spun yarn-like textured composite yarn according to claim 1 comprising a first step of subjecting said first bundle of continuous filaments doubled with said second bundle of continuous filaments to an intermingling and interlacing treatment to form at least 30 interlacing points per meter prior to said step of subjecting the intermingled and interlaced yarn formed during said first step to said draw-false twisting and crimping treatment.

3. A process for manufacturing a spun yarn-like textured composite yarn according to claim 1, wherein said first bundle of filaments consists of partially oriented filaments having a breaking elongation of 100 to 250%, said second bundle of filaments consists of undrawn filaments having a breaking elongation of at least 250%, and the difference in breaking elongation between said two bundles of filaments is at least 80%.

4. A process for manufacturing a spun yarn-like textured composite yarn according to claim 1 wherein the draw ratio is 1.2 to 2.5.

5. A process for manufacturing a spun yarn-like textured composite yarn according to claim 1, further comprising a raising treatment step carried out simultaneously with said draw false twisting and crimping treatment.

6. A process for manufacturing a spun yarn-like textured composite yarn according to claim 1, further comprising a raising treatment step carried out after said draw false twisting and crimping treatment.

7. A spun yarn-like textured composite yarn made by the process of claim 1, wherein said first bundle forms a false twisted core yarn composed of a plurality of filaments and said second bundle forms a wrapping yarn at least partially wrapping said core yarn helically, said wrapping yarn being composed of a plurality of false twisted filaments, the directions of helices of said wrapping yarn reversing along the yarn length, and some of said filaments constituting said wrapping yarn being entangled and interlaced with some of said filaments constituting said core yarn in the boundary region between said core yarn and said wrapping yarn.

8. A spun yarn-like textured composite yarn according to claim 7 wherein the direction of helices of said wrapping yarn reverses successively.

9. A spun yarn-like textured composite yarn according to claim 7 wherein some of the filaments constituting the outside portion of said wrapping yarn are cut to form fluffy free ends on the yarn surface.

10. A spun yarn-like textured composite yarn according to claim 9 wherein the density of fluffs is at least 50 filaments per meter.

11. A spun yarn-like textured composite yarn according to claim 9 wherein the number of fluffs having a fluff length of less than 2 mm is at least 80% of the total number of said fluffs.

12. A spun yarn-like textured composite yarn according to claim 7, further comprising a plurality of yarn portions wherein a plurality of said filaments of said wrapping yarn are interlaced with a continuous filament of said core yarn without wrapping around said core yarn.

13. A spun yarn-like textured composite yarn according to claim 7 wherein some of the filaments constituting the outside portion of said wrapping yarn have loopy configurations or are slackened.

14. A spun yarn-like textured composite yarn according to claim 7 wherein the filaments constituting said core yarn and the filaments constituting said wrapping yarn have at least 20 interlacing points per meter in the direction of the yarn length.

15. A spun yarn-like textured composite yarn according to claim 7 wherein said filaments are composed of a polyester-type polymer.

* * * * *